United States Patent [19]

Welsh

[11] 3,940,955

[45] Mar. 2, 1976

[54] YARN EXTRACTION AND WASHING APPARATUS

[75] Inventor: Paul Bryce Welsh, Wilmington, Del.

[73] Assignee: E. I. Du Pont de Nemours and Co., Wilmington, Del.

[22] Filed: Nov. 26, 1974

[21] Appl. No.: 527,348

[52] U.S. Cl. ..... 68/20; 28/1.4; 68/DIG. 1; 68/181 R; 68/183

[51] Int. Cl.[2] ..... D06B 5/06; D06B 21/02

[58] Field of Search..... 68/DIG. 1, 20, 181 R, 183, 68/3 SS, 5 D, 5 E, 6; 28/1.4

[56] References Cited

UNITED STATES PATENTS

| | | | |
|---|---|---|---|
| 2,509,279 | 5/1950 | Sisson | 68/20 X |
| 2,622,961 | 12/1952 | Finlayson et al. | 68/DIG. 1 |
| 2,624,189 | 1/1953 | Pendleton | 68/181 R X |
| 2,772,552 | 12/1956 | Nikles et al. | 68/181 R |
| 3,727,275 | 4/1973 | Ohayon | 28/1.4 |
| 3,837,186 | 9/1974 | Lefebvre et al. | 68/DIG. 1 |

FOREIGN PATENTS OR APPLICATIONS

| | | | |
|---|---|---|---|
| 39,311 | 10/1972 | Japan | 68/DIG. 1 |

*Primary Examiner*—Harvey C. Hornsby
*Assistant Examiner*—Philip R. Coe

[57] ABSTRACT

A yarn extraction and washing apparatus in which a particular arrangement of the yarn passage through the apparatus and fluid conduits connected to the yarn passage for washing and stripping liquid from the yarn and its method of use permits the stripped yarn to travel at a very low tension level.

2 Claims, 4 Drawing Figures

YARN EXTRACTION AND WASHING APPARATUS

BACKGROUND OF THE INVENTION

This invention relates to an improved wet spinning process for fibers and more particularly to the extraction of liquid from the fibers.

In the manufacture of certain solution spun synthetic polymeric yarn, an important process step concerns extraction of the liquor material from the yarn. This is usually accomplished by either passage of the yarn bundle over rotary rolls and under water sprays or through a plurality of immersion tanks filled with water or neutralizing agents. By the latter method, it is not uncommon to utilize at least four to six tanks for maximum liquor extraction. Although the technique is highly effective, it is inherently speed limited. The yarn material must be processed through the immersion tanks at relatively slow speeds due to excessive frictional drag that tends to build up between the liquid and the bundle fibers. In addition, relatively long immersion residence time is required in order for the water or neutralizer to thoroughly wash the yarn bundle. Thus, washing low denier yarn at speeds above 500 yards per minute tends to become impractical. Finally, at the higher speeds percent liquor carry over increases steeply further reducing washing efficiency. Numerous attempts have been made to improve textile yarn washing efficiency and treatment speed but these have been limited to relatively slow process speeds since high relative velocities tend to produce frictional drag which eventually damages the product.

Accordingly, it is an object of this invention to provide a compact, highly efficient yarn wash device capable of treatment of solvent-laden yarn at high throughput rates.

Another object of the present invention is to provide a multistage solvent extraction which subjects the yarn material to substantially no tension buildup.

SUMMARY OF THE INVENTION

The present invention provides for high speed, high efficiency wash treatment of solvent-laden yarn moving through a process such as described by Blades in U.S. Pat. No. 3,767,756 and involves a yarn washing and extraction apparatus that has a body with a straight passage therethrough and through which yarn passes for treatment. The passage includes a pair of extraction chambers connected by passage lengths of different cross-sectional areas. Conduits are angularly disposed into the passage for stripping liquid from the yarn before washing and final stripping by similarly disposed conduits.

More particularly, the extraction and washing apparatus includes a body having a passage extending along a straight axis therethrough and through which yarn travels for treatment, said passage including successively a first extraction chamber having means for draining the chamber, a first cylindrical length, a second cylindrical length having a greater cross-sectional area than said first length, a second extraction chamber having means for draining the chamber, said chamber being followed by a third cylindrical length equal in cross-sectional area to said first length; a first pair of conduits angularly disposed into the passage at the junction of the first extraction chamber and said first length to provide flow paths into the chamber counter-current with the yarn travel; a second pair of conduits angularly disposed into the passage at the junction between said first and second lengths to provide flow paths into the passage co-current with yarn travel; liquid supply means connected to said second pair of conduits; a third pair of conduits angularly disposed into the passage at the junction of the second extraction chamber and said third length to provide flow paths into the chamber counter-current with yarn travel; and gas supply means connected to the first and third pairs of conduits.

The invention also includes an improved method of washing and extracting liquid from a solution spun yarn between the quenching step and packaging step comprising: passing the yarn through an enclosed passage immediately following quenching step; while successively impinging opposed streams of gas against the yarn counter-current to its travel to remove quench liquid from the yarn; draining the removed quench liquid from the passage, said yarn carrying gas along said passage; impinging opposed streams of liquid against the yarn co-current to its travel, to turbulently mix said gas and said liquid to diffuse liquid into said yarn and reduce frictional drag on the yarn impinging opposed streams of gas against the yarn counter-current to its travel to remove diffused liquid from the yarn; and draining the removed diffused liquid from the passage.

DETAILED DESCRIPTION OF THE PREFERRED EMBODIMENT

Figure 1:
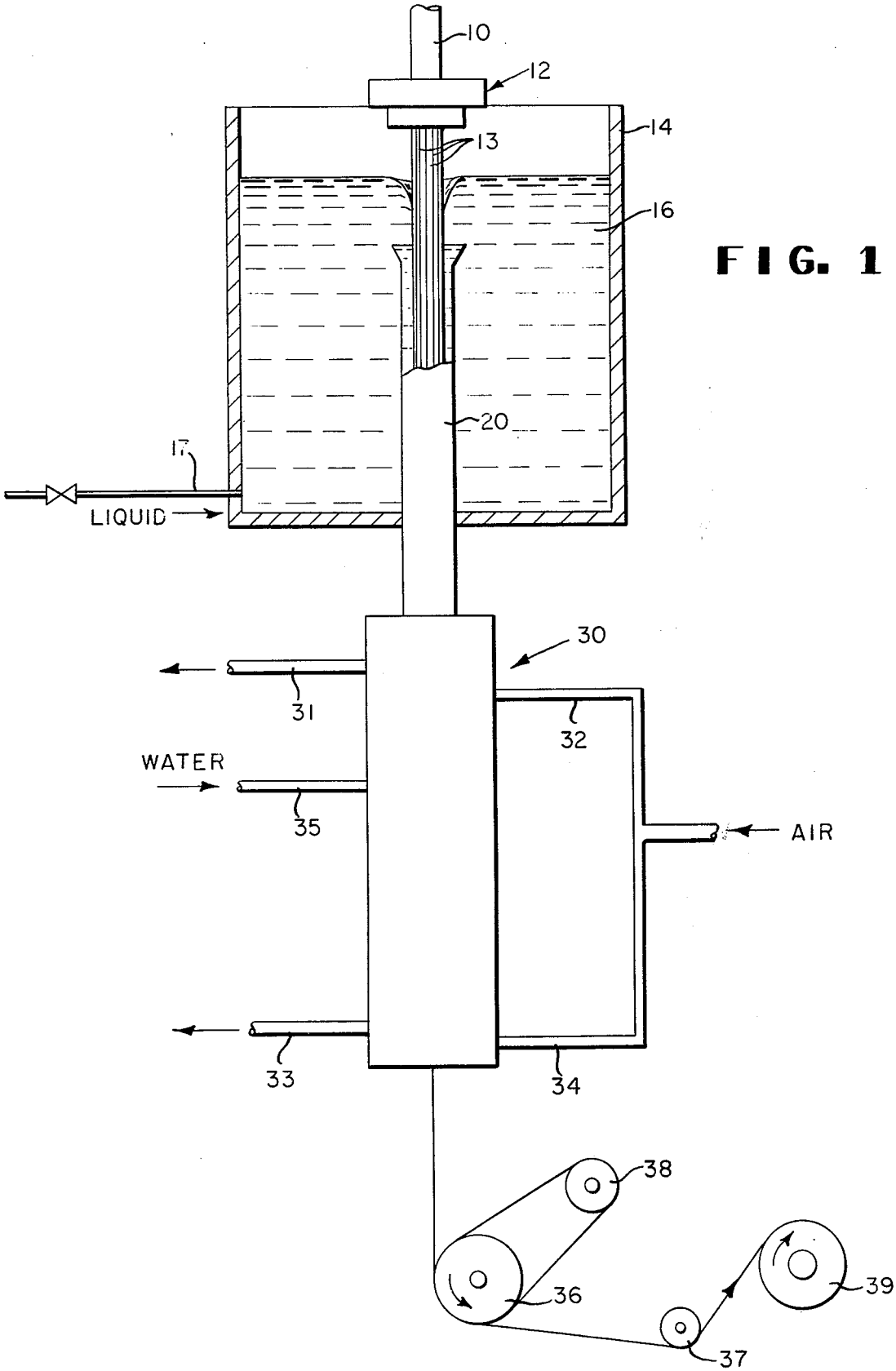
FIG. 1 is a schematic elevation of the invention used with a wet spinning process.

The wet spinning apparatus chosen for purposes of illustration is that used in the spinning process of Blades U.S. Pat. No. 3,767,756 and includes as general components thereof a transfer line 10 through which is pumped spinning dope to a spinning block 12 located above the vessel 14 containing a liquid coagulating bath 16 supplied from pipe 17. A spin tube 20 is immersed in the bath 16, extends through vessel 14 and connects to the extraction and washing apparatus generally designated as 30. Extruded filaments 13 are forwarded through coagulating liquid 16 that is flowing from vessel 14 through tube 20 into extraction washing apparatus 30 from which it is removed via drain pipe 31 with the assistance of air supplied through pipe 32. Water for washing the filaments is supplied through pipe 35 and removed via drain pipe 33 with the assistance of air supplied through pipe 34. The filaments are withdrawn from extraction wash apparatus 30 by driven roll 36 and its associated separator roll 38 and conducted under guide 37 for winding on rotating bobbin 39.

Figure 2:
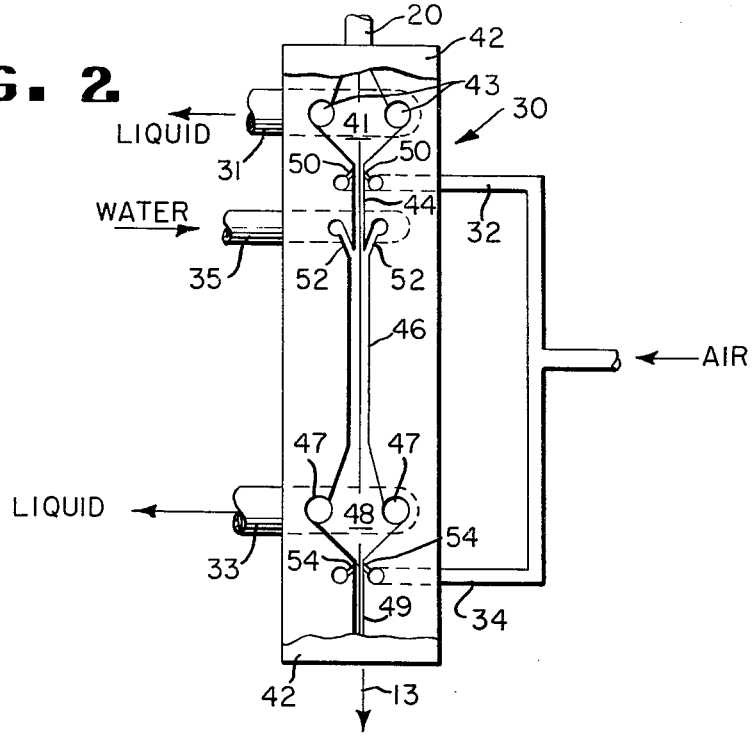
FIG. 2 is a schematic illustration of the wash extraction apparatus of FIG. 1.

As shown in FIG. 2, the extraction-wash apparatus is composed of a body 30 and a detachable cover 42 which is secured to the body by a conventional fastener (not shown). The body has a passage extending along a straight axis through which the filaments 13 travel for treatment. The passage includes a first extraction chamber 41 with outlets 43 connected to pipe 31 for draining the chamber and continues with a first passage length 44 joined to a second passage length 46 somewhat larger in cross section than passage length 44. A second extraction chamber 48 with outlets 47 connected to pipe 33 for draining the chamber is connected between second passage length 46 and a third passage length 49. A first pair of conduits 50 are angularly disposed into the passage at the junction of extraction chamber 41 and cylindrical length 44 to provide flow paths into chamber 41 for air supplied from pipe 32 counter-current to the filament travel. A second pair of conduits 52 are angularly disposed into the passage at the junction between the first length 44 and the second length 46 of the passage to provide flow paths into the length 46 for water supplied from pipe 35 co-current with the filament travel. Finally, a third pair of conduits 54 are angularly disposed into the passage at the junction of the second extraction chamber 48 and the length 49 to provide flow paths into chamber 48 for air supplied from pipe 34 counter-current to filament travel.

Figure 3:
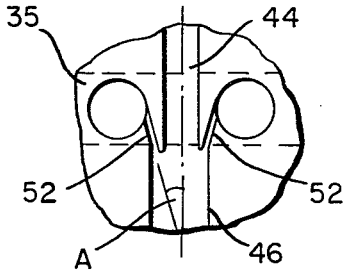
FIG. 3 is a schematic illustration of a pair of conduits angularly disposed into the yarn passage for extraction.
Figure 4:
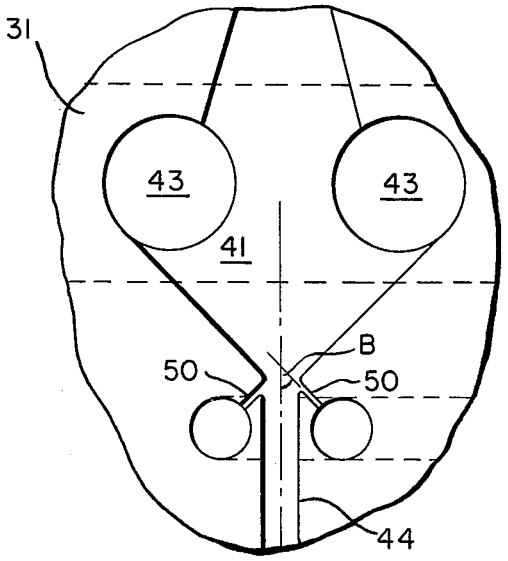
FIG. 4 is a schematic illustration of a pair of conduits angularly disposed into the yarn passage for stripping.

Referring now to FIGS. 3 and 4, orifices 52 intercept the passage at an angle A of about 15° while orifices 50 intercept the passage at an angle B of about 45°.

A useful embodiment employs rectangular slots 0.030 inch (0.764 mm.) wide and 0.281 inch (0.716 mm.) deep for conduits 50, 52 and 54, a 4-inch (10.0 cm.) long cylindrical section of 0.281 inch (0.716 mm.) I.D. for length 44 and a cylindrical section of 0.34 inch (0.890 mm.) I.D. for length 46.

In operation, high velocity streams of air from orifices 50 impinge against the moving filaments 13 and generate a highly turbulent action in extraction chamber 41 which removes solvent rapidly from the filaments to a receiver (not shown) via drains 43 and drain line 31. The filaments pass through a liquid free length of passage 44 carrying air along with them before engagement with water streams from orifices 52. The velocity of the dual water streams is adjusted to coincide closely with yarn speed. Below the orifices 52 the yarn passage is slightly enlarged, i.e., length 46 has a somewhat greater cross-sectional area than length 44 and provides a highly turbulent mixing action of air and water which reduces drag on the filament and assures maximum diffusion of the water into the filament bundle. At the end of length 46, the passage enlarges and blends into extraction chamber 48 where high velocity streams of air from orifices 54 impinge against the moving filament bundle in chamber 48 and generate a highly turbulent mixture of water solvent and air which is rapidly removed to a holding task (not shown) via drains 47 and pipe 33 leaving the filament bundle then to pass through liquid free passage length 49 and on to further processing or to a package windup. The function of the extraction chambers in combination with their respective jet orifices is critical to the operation of the system because by removing essentially all the liquid from the passage at these locations permits the filaments to pass through lengths 44, 49 with virtually no frictional drag and consequently no tension build up is encountered when passing through the successive stages. This tends to open the filament bundle and reduce resistance for removal of interstitial solvent. The filaments emerging from the extraction-wash apparatus are virtually free from excess liquid which obviates the need for cumbersome friction producing sealing devices.

The apparatus is not limited to a single set of impingement orifices but may also include a plurality of dual impingement orifices 52 arranged in series along the length 46. Each set of orifices would require an extraction chamber which would be interposed between successive sets of orifices along with a liquid free length of passage such as 49.

Although this invention has been disclosed in terms of using water as the washing liquid, it will be appreciated that other liquids can be used. For example, when the filaments contain sulfuric acid, a dilute (ca 1% aqueous solution of NaOH may be used to neutralize the acid and also remove $Na_2SO_4$ formed.

What is claimed is:

1. A yarn extraction and washing apparatus comprising: a body having a passage extending along a straight axis therethrough and through which yarn travels for treatment, said passage including successively a first extraction chamber having means for draining the chamber, a first passage length, a second passage length having a greater cross-sectional area than said first length, a second extraction chamber having means for draining the chamber, said second extraction chamber being followed by a third passage length being equal in cross-sectional area to said first length; a first pair of conduits angularly disposed into the passage at the junction of the first extraction chamber and said first length to provide flow paths into the chamber counter-current with the yarn travel; a second pair of conduits angularly disposed into the passage at the junction between said first and second lengths to provide flow paths into the passage co-current with yarn travel; liquid supply means connected to said second pair of conduits; a third pair of conduits angularly disposed into the passage at the junction of the second extraction chamber and said third length to provide flow paths into the chamber counter-current with yarn travel; and gas supply means connected to the first and third pairs of conduits.

2. The apparatus defined in claim 1, said passage lengths being cylindrical and said conduits being rectangular in cross section.

* * * * *